US005306080A

United States Patent [19]

Lautenschläger et al.

[11] Patent Number: 5,306,080

[45] Date of Patent: Apr. 26, 1994

[54] SYSTEM FOR FASTENING THE BACK END OF THE GUIDE RAIL OF A DRAWER SLIDE

[75] Inventors: Horst Lautenschläger, Reinheim; Horst Berger, Bielefeld, both of Fed. Rep. of Germany

[73] Assignee: MEPLA-Werke Lautenschläger GmbH & Co. KG, Fed. Rep. of Germany

[21] Appl. No.: 909,972

[22] Filed: Jul. 7, 1992

[30] Foreign Application Priority Data

Jul. 24, 1991 [DE] Fed. Rep. of Germany ..... 4124535

[51] Int. Cl.[5] ..... A47B 88/00

[52] U.S. Cl. ..... 312/334.5

[58] Field of Search ..... 312/334.7, 334.14, 334.24, 312/334.27, 330.1, 332; 248/429, 430

[56] References Cited

U.S. PATENT DOCUMENTS

| | | | |
|---|---|---|---|
| 3,090,662 | 5/1963 | Dargene . | |
| 3,328,107 | 9/1966 | Gutner | 312/334.27 |
| 3,750,993 | 8/1973 | Read . | |
| 4,244,546 | 1/1981 | Mertes . | |
| 4,441,773 | 4/1984 | Leiper | 312/330.1 |
| 4,511,187 | 4/1985 | Rees | 248/430 |
| 4,815,796 | 3/1989 | Röck | 312/330.1 |
| 5,039,181 | 8/1991 | Lautenschlager . | |

FOREIGN PATENT DOCUMENTS

| | | | |
|---|---|---|---|
| 648183 | 1/1951 | United Kingdom | 248/429 |

*Primary Examiner*—Peter R. Brown
*Assistant Examiner*—Janet M. Long

[57] ABSTRACT

A mounting system for the carcase-interior end of the guide rail (10) of a drawer guide for drawers and the like in the carcase of a cabinet at a distance from the inside surface of the associated carcase side wall. The guide rail (10) is formed as a channel which is fitted from underneath into a corresponding runner rail which can be fastened to the drawer and is formed by an inverted channel inside of which tracks are formed for rolling bodies. In the portion of the guide rail (10) engaged in the runner rail, tracks are also formed for the rolling bodies, so that the runner rail is displaceable relative to the guide rail. The section of the guide rail (10) engaged in the runner rail is bent from the horizontally disposed web of the rail. In the carcase-interior end portion of the guide rail (10) a tab (16) stands up from its horizontal web and is aligned transversely of the length of the guide rail, and is provided with detent teeth (18) on its edge pointing away from the web. A mounting piece (12) which can be fastened in the interior of the carcase serves to accommodate the guide rail; it has a supporting surface (24) extending under the back end of the horizontal web of the guide rail (10), and has a resilient tongue (26) which is provided above the supporting surface (24) at the level of the tab (16) on the guide rail, and bears parallel grooves (28) on its bottom running in the direction of the length of the guide rail, and it is forced against the detent teeth (18) of the tab (16).

8 Claims, 2 Drawing Sheets

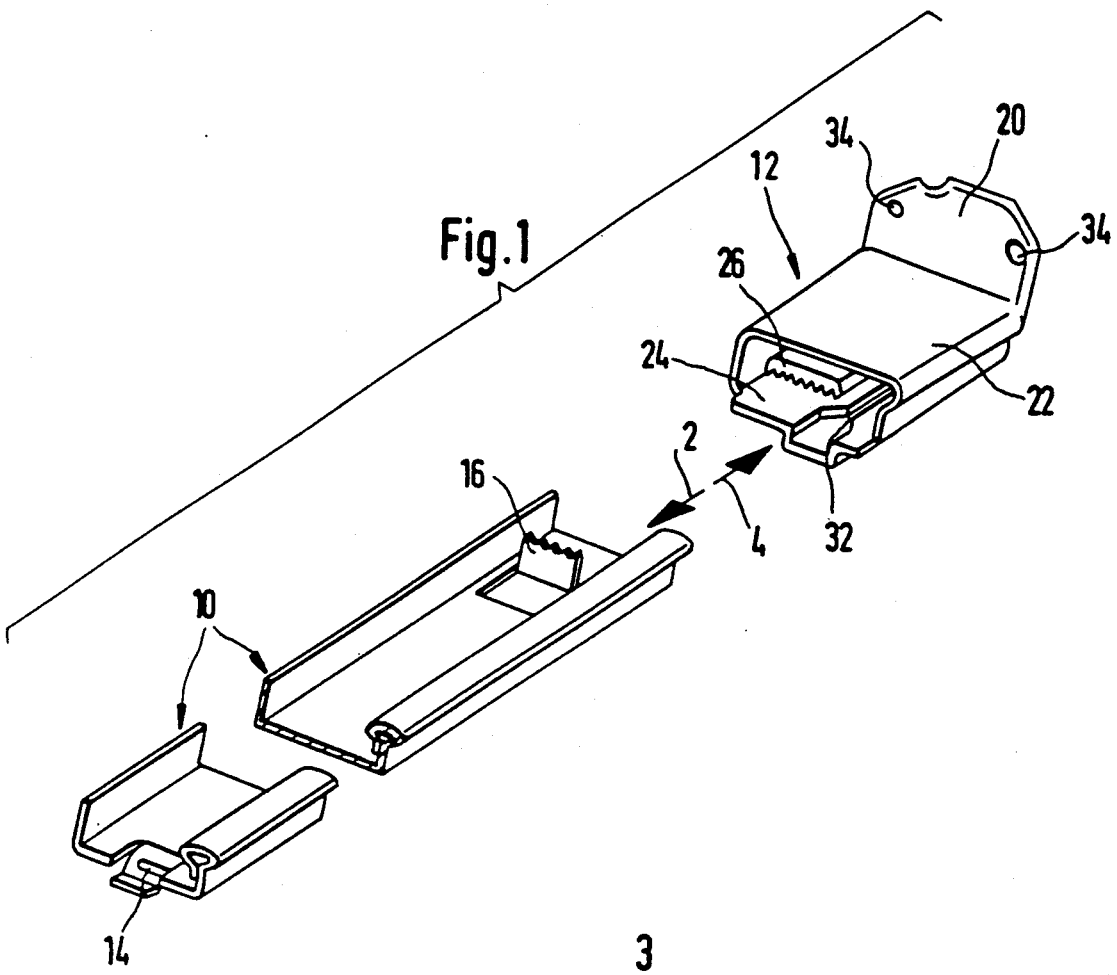
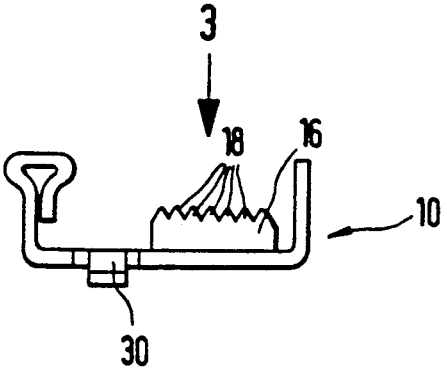
Fig. 2
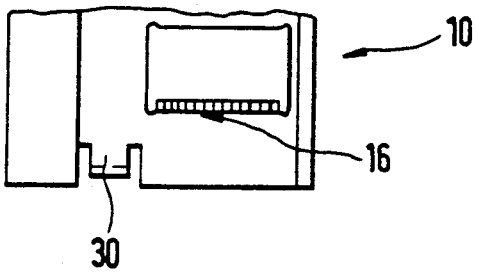
Fig. 3

SYSTEM FOR FASTENING THE BACK END OF THE GUIDE RAIL OF A DRAWER SLIDE

BACKGROUND OF THE INVENTION

1. Field of the Invention

The invention relates to a system for fastening the carcase-interior, rearward end of the guide rail of a slide for drawers and the like in the carcase of a cabinet at a distance from the inside surface of the associated carcase side wall, wherein the guide rail is configured as a shaped rail which enters from below into corresponding runner rail formed by an open-bottomed channel and fastenable to the drawer, and inside of the runner rail tracks are formed for rolling bodies which during a longitudinal displacement of the runner rail relative to the guide rail can roll on these runner rail tracks on the one side and in tracks formed in the portion of the guide rail that is engaged in the runner rail, the section of the profile of the guide rail that enters from below into the runner rail being bent down from a substantially horizontal limb of the guide rail profile.

Guide rails of drawer guides, by means of which drawers, slides, appliance holders and the like are mounted in a cabinet carcase so as to be able to be drawn out and pushed back in, are normally screwed directly onto the inside surface of the associated cabinet side wall. In certain cabinet types manufactured mostly by kitchen cabinet manufacturers in and for the United States of America, the front cabinet opening is, however, narrowed by a face frame running around it, with the result that drawers or the like can have only a width corresponding to the clear width between the vertical front edges of the frame. In this case, however, the guide rail of a drawer guide, which is to be fastened to the carcase, cannot be fastened to the cabinet side wall, but has to be set back into the carcase interior by the amount by which the frame projects beyond the inside surface of the associated cabinet side wall. The front end of the guide rail in this case is in an appropriate manner screwed to the inside surface of the free front edge of the frame, while its rearward end inside of the carcase has to be fastened to the back wall of the cabinet or carcase.

2. Description of the Related Art

For so-called "roller drawer guides" a fastening system has been developed for the carcase-interior end of the guide rail for mounting in cabinets of the kind described (DE-OS 38 32 701), in which a tab attached to the web of the guide rail and bent at right angles to a horizontal position can be inserted into an opening in a mounting piece which can be fastened to the carcase back wall and can be fixed at selectable displacement positions. This solution, however, in the case of the drawer guides here in question, in which the guide rail configured as a shaped rail is engaged from below in a corresponding runner rail formed by an open-bottomed channel, the runner rail being mounted on rolling bodies on the portion of the guide rail that is engaged in it, is difficult to realize in practice, and in particular the mounting of the guide rail would be problematical.

SUMMARY OF THE INVENTION

The invention is therefore addressed to the problem of creating a fastening system for the rearward end of the guide rail of drawer guides of the kind here in question, which will permit a quick and simple installation of the guide rail as well as any necessary horizontal adjustment of the position of the carcase-interior end of the guide rail, so as to be able to compensate for any inaccuracies that may have occurred in the production of the cabinet carcase or due to external influences.

Setting out from a fastening system of the kind described above, this problem is solved in accordance with the invention in that, in the carcase-interior end portion of the guide rail a tab is turned up from its horizontal web and is aligned transversely of the length of the guide rail, and it is provided with detent teeth on its edge pointing away from the flange, and in that a mounting piece is provided which can be fastened in the carcase interior, and has a supporting surface reaching beneath the rearward end of the horizontal web of the guide rail, and it has a resilient tongue at a level above the supporting surface corresponding to the level of the tab provided on the guide rail, the tongue being provided on its bottom with parallel grooves running in the longitudinal direction of the guide rail and urged against the detent teeth of the tab.

In order to guide the carcase-interior end of the guide rail positively into the correct mounting position during its first installation, the configuration is made such, in a desirable further development of the invention, that on the carcase-interior end of the horizontal web of the guide rail a projection extending toward the supporting surface of the mounting piece is provided, and that in the supporting surface a groove-like recess is provided which is open at the end remote from the back wall of the carcase, and which on its mouth side and in its end portion facing the back wall of the carcase, in which the projection of the guide rail is in the proper mounting position, is made wider transversely of the direction of the insertion of the guide rail than the projection, but in the intermediate portion diminishes gradually from the mouth to approximately the width of the projection, the position of the reduced-width portion of the recess with respect to the projection of the guide rail being selected such that, when the carcase-interior end is inserted between the supporting surface and the resilient tongue, it is positively guided to the correct mounting position.

The projection that, during installation, brings about the alignment of the guide rail relative to the mounting piece can be a tab cut from the carcase-interior end of the guide rail's horizontal web and bent downward.

The supporting surface, in a preferred further development of the invention, is formed by the inside surface of the bottom side of an open socket facing toward the front of the carcase, with the back end of the socket terminating in a mounting flange on the inside of the back wall of the carcase, and the resilient tongue reaches into the socket from the mounting flange toward the open end of the socket, i.e., toward the front of the carcase.

The force with which the resilient tongue is urged against the detent teeth of the upright tab provided at the end of the guide rail, and hence the resistance which the guide rail opposes to any horizontal shifting for the purpose of alignment in the carcase, can be increased—if necessary—by providing a spring means between the top of the resilient tongue and the inside surface of the portion of the socket wall above it, to increase the resilient resistance of the tongue against flexure. If it should be found that the tongue is too flexible for a particular application, it can be further stiffened afterward by inserting an appropriately resilient body between the upper side of the tongue and the inside surface of the socket.

On the other hand an excessively weak tongue—possibly due to reasons associated with injection-molding—can also be stiffened from the outset by forming the spring means of a thin web disposed between the upper side of the tongue and the inside surface of the wall of the socket.

The mounting flange is best made larger than the socket, so that it extends beyond it at least vertically, and then at least one, preferably two or more holes can be provided in the part of the flange outside of the socket, one for each of the mounting screws to be driven into the back wall of the carcase.

Alternatively, or additionally, at least one, preferably two studs at a distance apart, can project from the surface of the mounting flange facing the back wall of the carcase, so that they can be inserted into mating holes in the back wall of the carcase. These studs serve on the one hand for the precise alignment of the mounting piece at the given mounting point, but they can also provide additional retaining and fastening if they are oversize for the holes in the back wall that are to receive them, i.e., they can be in the form of "push-in" studs.

In a preferred embodiment of the invention the mounting piece is entirely one integral injection molding of plastic.

BRIEF DESCRIPTION OF THE DRAWING

The invention will be further explained in the following description of an embodiment, in conjunction with the drawing, wherein:

FIG. 1 is a perspective view of the guide rail of a drawer guide and of the corresponding mounting piece for the carcase-interior end of the guide rail, FIG. 2 is a view of the carcase-interior end of the guide rail, as seen in the direction of the arrow 2 in FIG. 1, FIG. 3 is a top view of the carcase-interior end of the guide rail, as seen in the direction of arrow 3 in FIG. 2.

DESCRIPTION OF THE PREFERRED EMBODIMENT

Figure 6:
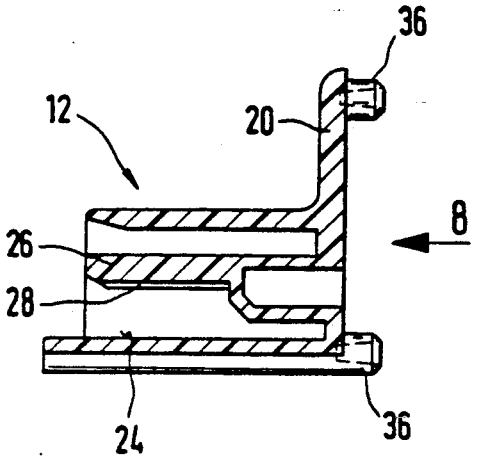
FIG. 6 is a sectional view seen in the direction of the arrows 6—6 in FIG. 4.
Figure 4:
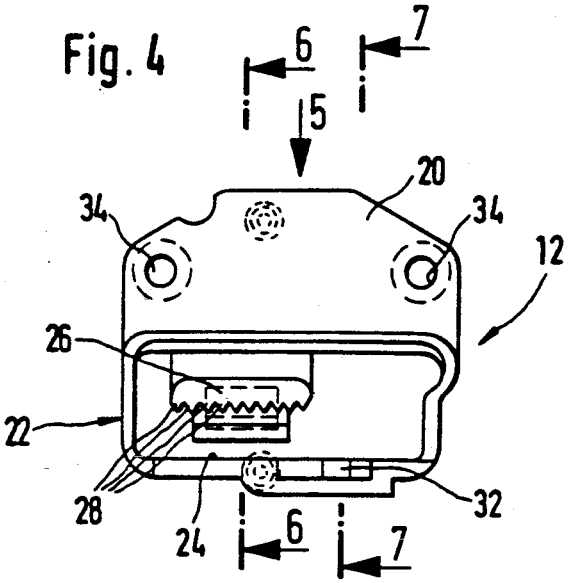
FIG. 4 is a view of the mounting piece, seen in the direction of arrow 4 in FIG. 1.
Figure 5:
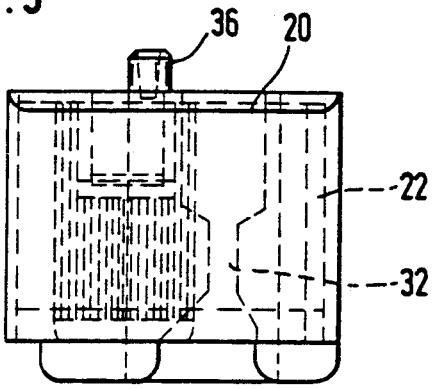
FIG 5 is a view of the mounting piece, seen in the direction of arrow 5 in FIG. 4.
Figure 7:
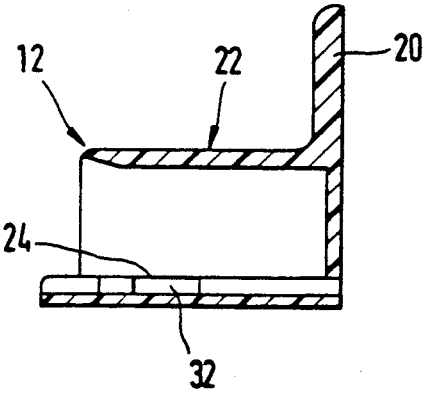
FIG. 7 is a sectional view, seen in the direction of the arrows 7—7 in FIG. 4.
Figure 8:
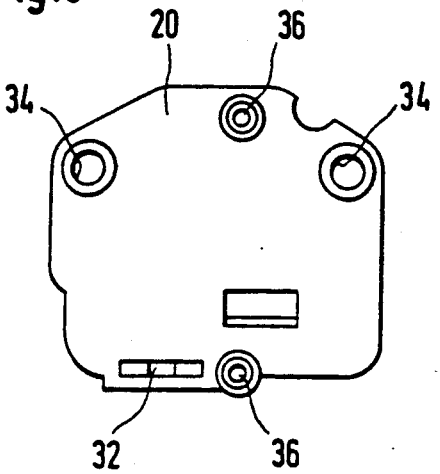
FIG. 8 is a view of the rear side of the mounting piece, seen in the direction of arrow 8 in FIG. 6.

FIG. 1 shows in perspective, on the one hand the front and the back end of a guide rail 10 of a drawer guide, which is to be fastened in the interior of a cabinet carcase, and on the other hand a mounting piece 12 which is to be fastened to the back wall of the cabinet carcase, accommodating the carcase-interior end of the guide rail 10 and into which the inner end of the guide rail can be inserted undisplaceably in the vertical direction, but to a given degree adjustably horizontally and parallel to the back wall of the carcase. The front end of the guide rail can be fastened in some suitable manner to a frame rail, not shown, defining the free opening to receive the drawer, a slot 14 for this purpose being represented diagrammatically on this front end. In the scope of the present invention, however, we are concerned only with the fastening of the back end of the guide rail by means of the mounting piece 12. As it can be seen in FIG. 1 and FIGS. 2 and 3, a tab 16 is cut and bent upward from its horizontal web at the rear end of the guide rail 10, and is provided with detent teeth 18 on its top edge. The mounting piece 12 receiving the inner end of the guide rail has, in turn, the form of a socket 22 open at the end confronting the guide rail and projecting from a mounting flange 20; the socket 22 has a flat bottom and top, and at a distance above the inside surface of the bottom wall of the socket, which has a surface 24 for bearing the bottom of the horizontal web of the guide rail 10 there is provided a resilient tongue 26 projecting from the mounting flange 20, which is provided on its bottom with parallel grooves 28 running in the direction of the length of the guide rail (FIGS. 4 and 6), whose cross section and pitch complements the detent teeth 18 of the tab 16. After the rear end of the guide rail 10 has been inserted into the mounting piece 12, the resilient tongue 26 is forced with bias onto the detent teeth of the tab 16 and fixes the guide rail in the vertical direction and in the horizontal direction. However, a transverse shifting of the end of the guide rail in the horizontal direction is possible whenever a horizontal pressure is exerted in the desired direction of adjustment against the guide rail end such that the inclined flanks of the grooves 28 of the resilient tongue are urged upward and the tongue flexes upwardly, so that then a detented displacement of the guide rail is accomplished. The force necessary for the horizontal displacement does not have to be applied manually by the person installing the guide rail, but can be produced by the runner rail fastened to the drawer as it is pushed onto the guide rail when the drawer is closed. In other words, the precise alignment of the guide rail is produced by the closing of the corresponding drawer.

In order to achieve a very precise alignment of the guide rail 10 in the mounting piece when the guide rail is installed therein, a narrow projections tab 30 is cut from the rear edge of the horizontal web of the guide rail and bent to point downwardly, and with it there is associated, in the supporting surface 24 of the mounting piece 12, a slot-like or groove-like recess 32 open at the front end, which is made decidedly wider than the tab 30 at the mouth end and in the back end facing the back wall of the carcase, in which the tab 30 is in the intended position for mounting the guide rail, while in the portion in between it gradually narrows to about half the width of the tab 30. Thus, when the carcase-interior end of the guide rail is inserted, the tab 30 is guided to a predetermined correct mounting position by the portion of reduced width of the recess. Since the detent teeth 18 of the upturned tab 16 do not come into engagement with the grooves 28 of the resilient tongue 26 until the transverse alignment of the guide rail in the narrow portion of the recess 32 has been accomplished, upward flexing of the tongue to the degree required for a transverse adjustment is unnecessary when the guide rail 10 is installed in the mounting piece 12, but only the slight flexure needed to produce the required bias of the tongue. A resilient spring element increases the resilient resistance of the tongue 26 to flexure and is provided between the upper side of the resilient tongue 26 and the inside surface of the section of the wall of the socket above it. The resilient spring element is formed by a thin web disposed between an upper side of the tongue 26 and an inside surface of the wall of the socket 22.

The mounting piece 12 can be fastened to the back wall of the carcase by screwing, and for this purpose, in the case of the mounting piece 12 represented in the drawings, two holes or openings 34 are provided in the mounting flange 20, and through them mounting screws can be driven into the back wall of the cabinet. In addition, two studs 36 provided at a vertical distance apart protrude from the back of the mounting flange and are forced into mating holes predrilled in the back wall of the carcase. These studs serve for the precise positioning of the mounting flange 20 when it is installed on the back wall of the carcase, and can furthermore also provide support in addition to the screws for the weight of the drawer transmitted by the guide rail to the mounting piece.

It can be seen that, in the embodiment represented, mounting pieces of mirror-image symmetry are required for the right and left guide rails. It is apparent, however, that if the resilient tongue were centered in the socket 22 and if the aligning recess 32 were also centered in supporting surface 24, a mounting piece suitable both for a right-hand and for a left-hand guide rail can be developed, which then would only have a greater width. For the sake of economy of material, therefore, the use of two mirror-image mounting pieces 1 is preferred at the present time for a pair of drawer guides. The mounting pieces 12 are manufactured by injection molding from an appropriate thermoplastic.

We claim:

1. A mounting system comprising:

A) a guide rail having an end, wherein said end of said guide rail of a slide for drawers includes means for fastening said guide rail to a carcase of a cabinet, said end to be fastened being a carcase-interior back end of said guide rail which is for fastening at a distance from an inside surface of a carcase side wall, the guide rail being formed as a channel and including means for filling to a corresponding runner rail formed by an open-bottomed hollow shape which can be fastened to a part to be drawn out, including and roller tracks formed inside of the runner rail, for rolling bodies which can roll on these runner rail roller tracks on one side; said guide rail including and roller tracks formed in a portion thereof for engaging a runner rail on another side, said guide rail roller track having a profile section for extending from below into the runner rail and being bent from a substantially horizontally disposed profile limb;

B) a tab (16) of a carcase-interior end portion of said guide rail which extends upwardly therefrom and is aligned transversely of the length of the guide rail from the rail's horizontal web, said tab having detent teeth (18) on its defining edge remote from the web;

C) a mounting piece (12) including means for fastening to the interior of the carcase and having a supporting surface (24) extending under a back end of the horizontal web of the guide rail (10), said mounting piece having a resilient tongue (26) at a distance above the supporting surface (24) approximately at the level of the tab (16) provided on the guide rail and said tongue having a bottom with parallel grooves (28) running in a lengthwise direction of the guide rail and thrusting with bias against the detent teeth (18) of the tab (16); and said supporting surface (24) being formed by an inside surface of the bottom horizontal wall of a socket (22) that is closed at the carcase-interior end by a mounting flange (20) but is open at the opposite end in the direction out of the carcase interior, and the resilient tongue (26) projects from the mounting flange (20) within the socket (22) toward an open end of the socket (22).

2. The mounting system according to claim 1, wherein said carcase-interior end of the horizontal web of the guide rail (10) has a projection (tab 30) thereon, said projection extending to the supporting surface (24) of the mounting piece (12) and the supporting surface (24) has a groove-like recess (32) open-mouthed at an end remote from a back wall of a carcase and which at the mouth end and in the end portion facing a back wall of a carcase where the projection of the guide rail (10) is in the intended mounting position, is wider transversely of a direction of insertion of the guide rail than the projection (30), but in the portion in between it diminishes gradually from the mouth to approximately the width of the projection (30), while the position of the portion of reduced width of the recess (32) with respect to the projection (30) of the guide rail (10) is selected so that the guide rail (10), upon insertion of its carcase-interior end between the supporting surface (24) and the resilient tongue (26) is guided positively into a correct mounting position.

3. The mounting system according to claim 2, wherein the projection is formed by a tab (30) cut from the end of the horizontal web of the guide rail (10) and bent downwardly.

4. The mounting system according to claim 1, wherein a resilient spring element increasing the resilient resistance of the tongue (26) to flexure is provided between the upper side of the resilient tongue (26) and the inside surface of the section of the wall of the socket (22) above it.

5. The mounting system according to claim 4, wherein the resilient spring element is formed by a thin web disposed between an upper side of the tongue (26) and an inside surface of the wall of the socket (22).

6. The mounting system according to claim 1, wherein the mounting flange (20) extends beyond the socket (22) at least in the vertical direction, and that in the section of the mounting flange (20) lying outside of the socket (22) at least one mounting opening (34) is provided for a mounting screw that can be driven into a back wall of a carcase.

7. The mounting system according to claim 1, wherein at least one, preferably two separate studs (36) project from the surface of the mounting flange (20) facing the back wall of the carcase, said studs for insertion into mating openings in the back wall of the carcase.

8. The mounting system according to claim 1, wherein the mounting piece (12) is an integral plastic injection molding.

* * * * *